US006672794B2

(12) United States Patent
Reichborn

(10) Patent No.: US 6,672,794 B2
(45) Date of Patent: Jan. 6, 2004

(54) QUICK DISCONNECT TUBE CLEANING BRUSH COUPLING

(75) Inventor: Per K Reichborn, Greenwich, CT (US)

(73) Assignee: Goodway Technologies Corporation, Stamford, CT (US)

( * ) Notice: Subject to any disclaimer, the term of this patent is extended or adjusted under 35 U.S.C. 154(b) by 337 days.

(21) Appl. No.: 09/741,274

(22) Filed: Dec. 19, 2000

(65) Prior Publication Data

US 2001/0042277 A1 Nov. 22, 2001

Related U.S. Application Data

(63) Continuation-in-part of application No. 09/574,045, filed on May 18, 2000, now abandoned.

(51) Int. Cl.[7] ..... F16D 1/00; B65G 3/18

(52) U.S. Cl. ..... 403/325; 403/327; 403/379.2

(58) Field of Search ..... 403/321–327, 403/331, 379.2, 381; 15/104.09, 179, 176.1–176.6; 285/67, 325–327

(56) References Cited

U.S. PATENT DOCUMENTS

| | | | | | |
|---|---|---|---|---|---|
| 2,257,321 | A | * | 9/1941 | Arlond | 285/67 |
| 2,328,294 | A | * | 8/1943 | Potter | 403/331 |
| 3,220,757 | A | * | 11/1965 | Potter | 403/340 |
| 3,345,711 | A | * | 10/1967 | McCarthy | 24/573.11 |
| 5,106,224 | A | * | 4/1992 | van Gelderen | 403/315 |
| 5,809,601 | A | * | 9/1998 | Rivera | 15/23 |

* cited by examiner

*Primary Examiner*—Anthony Knight
*Assistant Examiner*—Michael J. Kyle
(74) *Attorney, Agent, or Firm*—Patrick J. Walsa

(57) ABSTRACT

A coupling particularly suited for brushes for tube cleaning operations includes interfitted shaft and brush coupling members retained by a locking mechanism in axial alignment for rotation in tube cleaning operations. The shaft and brush coupling interfit and the locking mechanism are suited for rapid mounting and replacement of the brush coupling. In a preferred form the locking mechanism comprises a sleeve and spring in nested reglation to each other mounted axially of the coupling. A brush coupling adapter may form part of the coupling for receiving a standard brush element.

4 Claims, 3 Drawing Sheets

QUICK DISCONNECT TUBE CLEANING BRUSH COUPLING

RELATED APPLICATION

This application is a continuation-in-part of application Ser. No. 09/574,045 filed May 18, 2000 now abandoned.

BACKGROUND OF THE INVENTION

The present invention relates to tube cleaning and particularly to scrubbers for cleaning the interior surfaces of tubes installed in industrial equipment such as boilers, chillers, condensers, heat exchangers, absorption machines and so forth. Such equipment ordinarily is fitted with tubes having a smooth or enhanced interior surface, and the interior surfaces are readily cleaned by means of a rotary brush. The rotary brush has a twisted steel wire spine securing bristles as illustrated in U.S. Pat. No. 5,426,807.

In operation, conventional tube cleaning equipment for tubes passes a rotary brush along the interior length of each tube to scrub soot and dirt from the tube surface. The rotary brush is accompanied by a stream of water to flush scrubbed soot and dirt from the tube.

In conventional practice rotary brushes are fitted to a rotary drive shaft by suitable screw thread means as shown for example in U.S. Pat. Nos. 2,693,611; 4,666,530; and 5,809,601.

Such screw threads are adequate for a reliable connection, for efficiently transmitting rotary motion to the brush, and are economical. However, there are operational limitations to a screw thread connection in that reverse rotation of the drive shaft tends to unthread the brush from the drive shaft so that a lock nut must be tightened in place to prevent unthreading. In addition, a change of brush requires the steps of loosening the lock nut, unscrewing the brush from the drive shaft, screwing a replacement brush onto the drive shaft, and re-securing the lock nut. In applications where brush changes are routine or frequent, the process of removing and replacing threaded connections and their lock nut becomes time consuming and undesirable in situations involving performance of a maintenance schedule on power plant equipment and other situations where "down time" is costly.

The present invention provides a quick connect/disconnect rotary brush as an improvement over conventional equipment and practice.

SUMMARY OF THE INVENTION

The present invention comprises a rotary brush coupling capable of forward and reverse rotation without special arrangements, and of rapid connect/disconnect of brush to rotary drive shaft.

In a preferred form, the invention comprises a shaft coupling connected at one end to a flexible rotary drive shaft, the shaft coupling having at its other end a recess for receiving a brush coupling, and having a locking or retaining sleeve secured to the shaft coupling for movement between an open position in which a brush coupling may be fitted to or removed from the shaft coupling, and a closed position for securing a brush coupling in place for rotation and use.

The shaft coupling has a long axis and a brush coupling recess accessible in a direction normal to the axis so that the brush coupling is inserted side to side onto the shaft coupling by a sliding motion. The shaft coupling recess and the brush coupling have mating contours for ease of interfitting, smooth rotation, axial pushing and pulling as a coupling.

In preferred form, the locking sleeve is slidably mounted to the shaft coupling and comprises a cylindrical sleeve positioned and retained along the exterior of the shaft coupling body for covering and uncovering the shaft coupling recess to secure a brush coupling in place on the shaft coupling for rotation and use and to accommodate rapid brush change. The locking sleeve holds the brush coupling in place against side to side movement with respect to the shaft axis while the brush coupling contour fixes and holds axial brush position in the shaft recess under the locking sleeve for rotation in use.

A locking spring fitted to the shaft coupling urges the locking sleeve into closed position over the shaft coupling recess. In preferred form, both the locking sleeve and locking spring are positioned and retained on the exterior surface of the shaft coupling. In use, the locking sleeve slides axially of the shaft coupling against spring force, and after a change of brush couplings, the sleeve is released and springs back to locked position.

In another preferred form of the invention, the locking sleeve and the locking spring are mounted on the shaft coupling in nested relation to each other with the locking sleeve enclosing the spring on the shaft coupling.

An aspect of the invention is to provide a brush coupling adapter for quick connection to a shaft coupling as in the case of the preferred embodiment, and for receiving a brush member by means of a standard threaded connection.

The quick disconnect tube cleaning brush is of robust, economic construction facilitating reliable and efficient rotary connection between drive shaft and rotary brush, while permitting immediate brush removal and replacement during tube cleaning operations.

Specific examples are included in the following description for purposes of clarity, but various details can be changed within the scope of the present invention.

OBJECTS OF THE INVENTION

An object of the invention is to provide a new and improved coupling for brushes.

Another object of the invention is to a quick disconnect brush coupling for rapid change of brushes on a drive shaft.

Another object of the invention is to provide a brush coupling with a sliding side-to-side connection of brush to drive shaft with locking sleeve to secure brush in position for rotary and/or axial use.

Another object of the invention is to provide a quick disconnect rotary brush coupling with a shaft coupling recess accessible from one side of the shaft coupling so as to retain structural integrity of the brush coupling in view of operational stresses encountered in practice.

Another object of the invention is to provide a quick disconnect brush coupling which is robust for reliable and efficient transmission of motion to brush, simple to interchange by operator at tube cleaning site, and economical.

Another object of the invention is to provide a brush coupling adapter for connection to a shaft coupling in accordance with the invention, and for use with a conventional tube cleaning brush.

Another object of the invention is to provide a quick disconnect brush coupling with locking sleeve and locking spring components in nested relation to each other on the shaft coupling with the sleeve enclosing the spring.

Other and further objects of the invention will become apparent with an understanding of the following detailed description of the invention or upon employment of the invention in practice.

BRIEF DESCRIPTION OF THE DRAWING

A preferred embodiment of the invention has been chosen for detailed description to enable those having ordinary skill in the art to which the invention appertains to readily understand how to construct and use the invention and is shown in the accompanying drawing in which.

DETAILED DESCRIPTION OF THE PREFERRED EMBODIMENT

Figure 1:
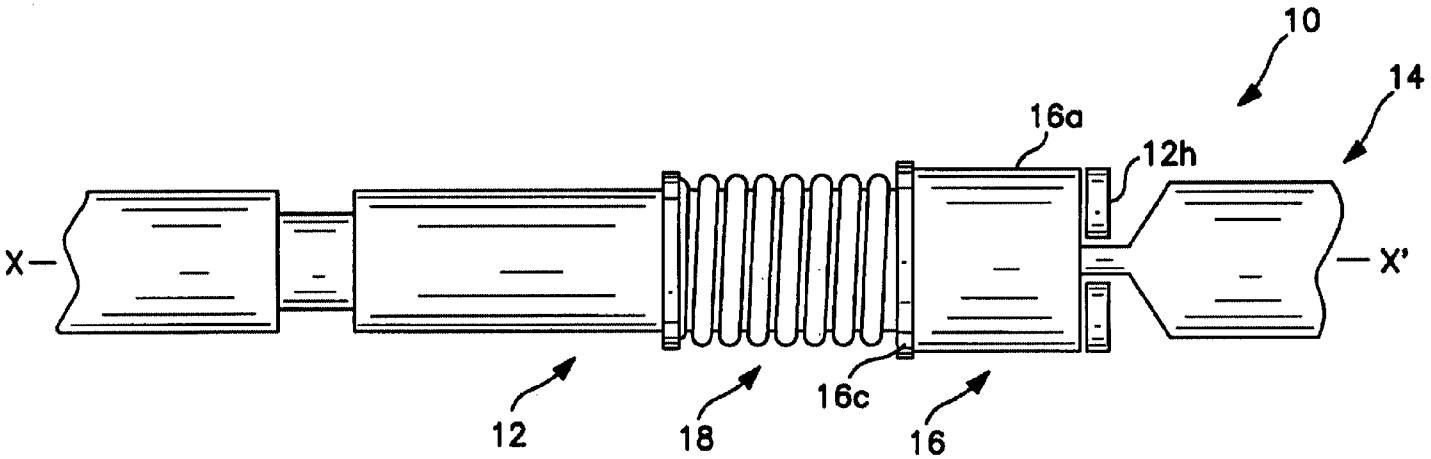
FIG. 1 is a side elevation view showing a preferred embodiment of quick connect/disconnect coupling according to the invention.
Figure 2:
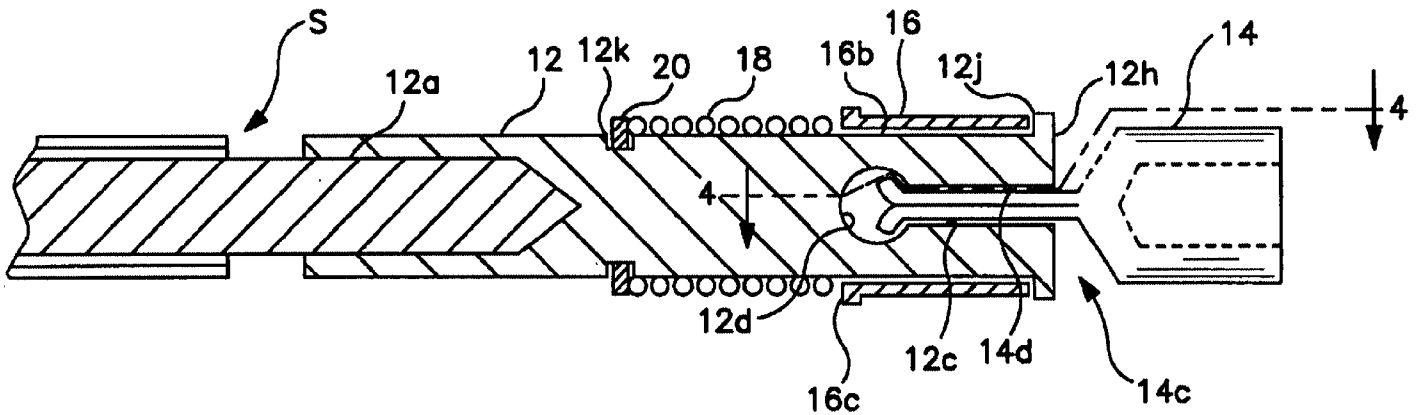
FIG. 2 is a longitudinal section of the coupling of FIG. 1.

Referring to the drawing, preferred embodiments of the quick disconnect coupling 10 are shown in FIGS. 1–4 and 7–8 and comprise a shaft coupling 12 in assembly along axis x-x' with a brush coupling 14, and with the coupling assembly or connection held together by a locking sleeve 16 slidably mounted on the shaft coupling, and with a locking spring 18 urging the sleeve into the closed position of FIGS. 1 and 2.

The shaft coupling 12 comprises a generally cylindrical member having a rear recess 12*a* for receiving a drive shaft S with the wall of the recess securely crimped onto the drive shaft for transmitting drive shaft motion to the shaft coupling.

Figure 3:
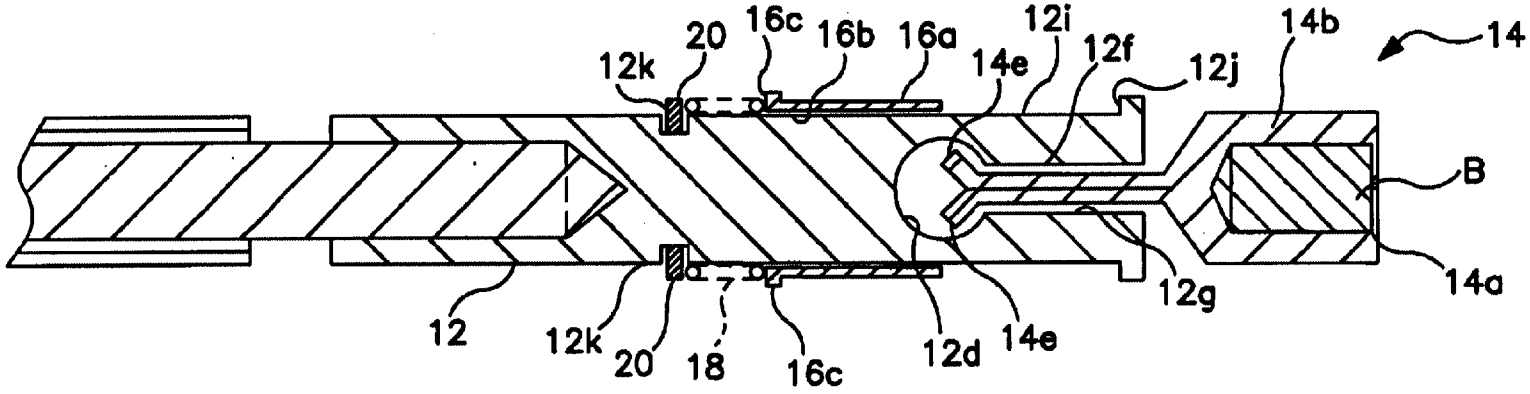
FIG. 3 is a longitudinal section of the coupling of FIG. 1 with locking sleeve open.
Figure 4:
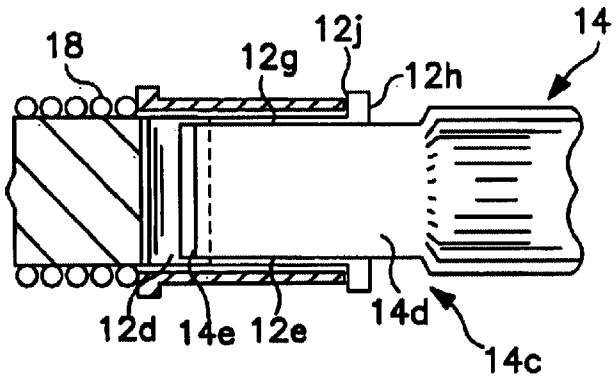
FIG. 4 is a section view taken along line 4—4 of FIG. 2.

The shaft coupling further includes a forward recess 12*c* for receiving the brush coupling 14. As shown in FIGS. 2–4, the forward recess 12*c* extends laterally through the shaft coupling 12 and is defined by a generally cylindrical transverse bore 12*d* communicating with a forwardly extending slot 12*e* defined by confronting parallel planes 12*f*–*g* lying between the bore 12*d* and the forward face 12*h* of the shaft coupling. Viewed from the side as in FIG. 2, the forward recess has the outline of a key-hole.

In preferred form, the locking sleeve 16 comprises a cylinder 16*a* with inner surface 16*b* in close conformity to the outer surface 12*i* of the forward portion of the shaft coupling. The locking sleeve has a length selected to fully enclose the brush coupling 14 within the shaft coupling recess 12*c*. Sliding movement of the locking sleeve is constrained by a shoulder 12*j* at the front end of the shaft coupling, and by the locking spring 18. Preferably, the outer surface of the locking sleeve is textured.

The locking spring 18 is preferably a coil spring encircling the shaft coupling and held in place at one end by a snap ring 20 positioned in a shaft coupling groove 12*k*. The other end of the spring abuts an annular rim 16*c* forming part of the locking sleeve.

In use, an operator slides the sleeve against the spring to open the recess for removing and replacing a tube cleaning brush, and releases the sleeve to hold the replacement brush in operating position.

The brush coupling 14 appears in FIGS. 1–4, and comprises a generally cylindrical body with forward recess 14*a* for receiving a brush B, with the recess wall 14*b* crimped over the brush to hold it securely in place. The rear section 14*c* (FIG. 4) of the brush coupling is formed for mating connection to the shaft coupling recess, and includes a tang 14*d* and edges 14*e* which are preferably canted 90° to the longitudinal axis for fitting within the key-hole contour of the shaft coupling recess.

When connected, and with the locking sleeve in place, the shaft and brush couplings are stationary with respect to one another for efficiently and reliably transmitting rotary motion to the brush for tube cleaning operations. For a change of brush, the locking sleeve slides open, the brush coupling removed and replaced, the sleeve closed, and the operator is ready to continue tube cleaning.

Figure 5:
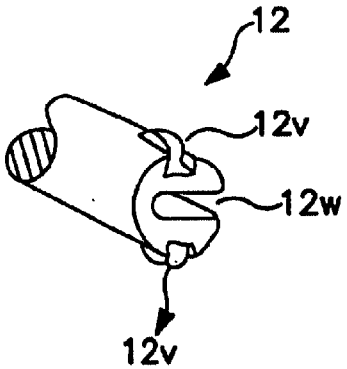
FIG. 5 is a fragmentary perspective view of a modified embodiment of shaft coupling according to the invention illustrating retaining shoulders formed at the front face of the coupling, and a shaft coupling recess extending partly through the coupling.

A modified shaft coupling 12 is shown in fragmentary perspective in FIG. 5 and comprises a generally cylindrical member having a forward recess 12*w* for receiving the brush coupling with the forward recess extending partially through the shaft coupling. When assembled, the sleeve and spring (not shown in FIG. 5) are constrained by shoulders 12*v* formed at the forward face of the shaft coupling after assembly of sleeve and spring components by swaging or other suitable impact metal forming technique at the front face of the shaft coupling.

Figure 6:
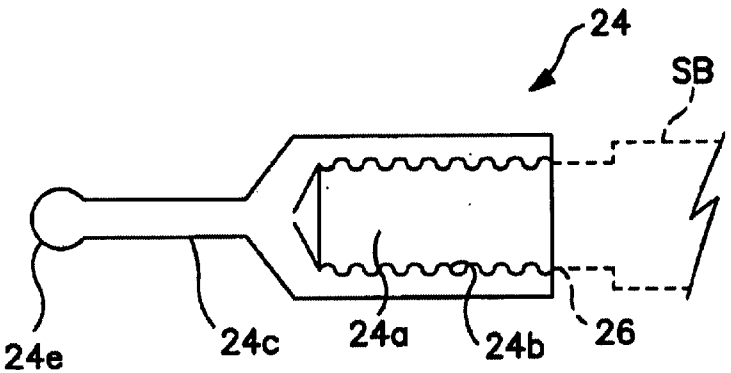
FIG. 6 is a longitudinal side elevation view partially in section of a brush coupling adapter according to the invention.

A brush coupling adapter 24 appears in FIG. 6, and comprises a generally cylindrical body with forward recess 24*a* with threaded interior surface 24*b* for receiving a standard brush SB having a threaded fitting 26 to hold the brush securely in place for tube cleaning operations. The rear section of the brush coupling is formed for mating connection to the shaft coupling recess 12*c*, and includes a tang 24*c* and end contour preferably in the form of a cylindrical crosshead 24*e* conforming to the transverse cylindrical portion 12*d* (FIGS. 1–4) of the keyhole.

Figure 8:
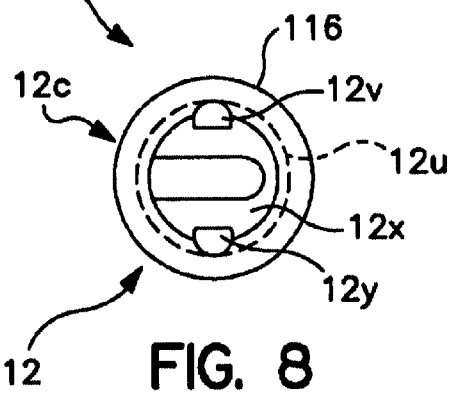
FIG. 8 is a front end view thereof.
Figure 7:
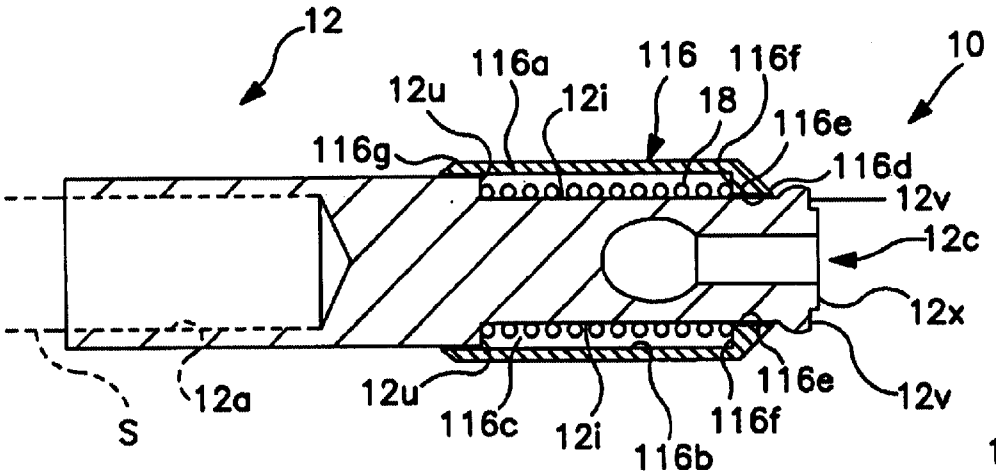
FIG. 7 is a longitudinal side elevation view in section of another preferred brush coupling according to the invention.

Referring to FIGS. 7 and 8 of the drawing, another preferred embodiment of the quick disconnect coupling 10 comprises a shaft coupling 12 for assembly with a brush coupling 14 or adapter 24 of FIGS. 1–6, with the coupling assembly retained by a locking sleeve 116 slidably mounted on the shaft coupling, and with a locking spring 18 urging the sleeve into the closed position of FIG. 7.

The shaft coupling 12 comprises a generally cylindrical member having a rear recess 12*a* for receiving a drive shaft S with the wall of the recess securely crimped onto the drive shaft for transmitting rotary drive shaft motion to the shaft coupling.

The shaft coupling further includes a forward recess 12*c* for receiving a brush coupling 14 or adapter 24. As shown in FIGS. 7 and 8, the forward recess 12*c* extends partially through the shaft coupling 12 in the manner of the embodiment of FIG. 5. Viewed from the side as in FIG. 7, the forward recess has the outline of a key-hole.

The surface of the shaft coupling is recessed 12*i* beginning at shoulder 12*u* and extending to the forward end 12*x* of the coupling. Shoulders 12*v* are formed at the forward face of the shaft coupling in the same way as in the embodiment of FIG. 5 for retaining the sleeve and spring on the shaft coupling.

In preferred form, the locking sleeve 116 comprises a cylinder 116*a* with inner surface 116*b* spaced from the recessed surface 12*i* of the shaft coupling to define a spring receiving space 116*c* between the shaft coupling surface and the locking sleeve. The locking sleeve further includes an inwardly directed flange 116*d* defining a cylindrical surface 116*e* for sliding engagement with the recessed coupling surface 12*i* and an annular shoulder 116*f* by which the sleeve engages and moves the spring.

The locking spring 18 is preferably a coil spring as described above in FIGS. 1–4.

The locking sleeve has a length selected to fully enclose the locking spring and to enclose the brush coupling within the shaft coupling recess 12*c*. The rear margin 116*g* of the sleeve engages and slides along shaft coupling surface 12*y* and together with flange surface 116*e* provides for sliding of the sleeve on the coupling while always remaining in covering relation to the spring.

The locking spring 18 is enclosed and retained in the spring receiving space by the locking sleeve shoulder 116*f* for compression against recess shoulder 12*u*. The locking sleeve, in turn, is kept in place (FIG. 7) by the spring and by shoulders 12*v*

In use, an operator slides the sleeve against the spring to open the recess for removing and replacing a tube cleaning brush, and releases the sleeve to hold the replacement brush in operating position.

When connected, and with the locking sleeve in place, the shaft and brush couplings are stationary with respect to one another for efficiently and reliably transmitting rotary motion to the brush for tube cleaning operations. For a change of brush, the locking sleeve slides open, the brush coupling removed and replaced, the sleeve closed, and the operator is ready to continue tube cleaning.

It is therefore understood that the invention provides improved quick connect couplings for a tool to a drive shaft for efficient operation in tube cleaning applications. The quick connect couplings are characterized by slip engagement of brush or tool coupling to shaft coupling, and by maintenance of slip engagement as the coupling unit rotates for tube cleaning operation. The quick connect couplings provide robust, reliable, easy to use, economical, energy efficient means to enable an operator to interchange brushes and other tools in meeting a busy plant maintenance schedule for minimizing downtime.

Various changes may be made to the structure embodying the principles of the invention. The foregoing embodiments are set forth in an illustrative and not in a limiting sense. The scope of the invention is defined by the claims appended hereto.

I claim:

1. A brush coupling for a rotary drive shaft comprising a shaft coupling secured to an end of the drive shaft and a brush received by the shaft coupling, the shaft coupling having a shaft coupling recess for receiving the brush for rotation with the drive shaft and shaft coupling for tube cleaning, a sleeve mounted for sliding movement on the shaft coupling to open the shaft coupling recess for reception of the brush therein and to close the shaft coupling recess for retaining the brush, the shaft coupling having first and second retaining means, the sleeve having retaining means intermediate the said first and second retaining means, a spring member fitted over the shaft coupling in engagement with the shaft coupling first retaining means and with the sleeve retaining means so that the spring urges the sleeve into closing relationship with the shaft coupling recess to retain the brush within the recess for rotation with the shaft coupling and drive shaft, and the shaft coupling second retaining means for retaining both the sleeve and the spring on the shaft coupling.

2. A brush coupling for a rotary drive shaft comprising a shaft coupling secured to an end of the drive shaft and a brush received by the shaft coupling, the shaft coupling having a shaft coupling recess having a key-hole contour for receiving the brush for rotation with the drive shaft and coupling for cleaning tubes, a sleeve mounted for sliding movement on the shaft coupling to open the shaft coupling recess for reception of the brush therein and to close the shaft coupling recess for retaining the brush, the shaft coupling having first and second retaining means, the sleeve having retaining means intermediate the said first and second retaining means, a spring member fitted over the shaft coupling in engagement with the shaft coupling first retaining means and with the sleeve retaining means so that the spring urges the sleeve into closing relationship with the shaft coupling recess to retain a brush within the recess for rotation with the shaft coupling and drive shaft, the shaft coupling second retaining means for retaining both the sleeve and the spring on the shaft coupling, and the sleeve having a length extending from the shaft coupling second retaining means to a shaft coupling surface beyond the shaft coupling first retaining means so that the sleeve remains in covering relation to the spring member.

3. A brush coupling for a rotary drive shaft comprising a shaft coupling secured to an end of the drive shaft, the shaft coupling having a forward recess for receiving a brush for rotation with the drive shaft and coupling, the shaft coupling having a surface recess defined by a shaft coupling shoulder with the surface recess extending to the forward end of the shaft coupling, the shaft coupling shoulder defining a first retaining means, a sleeve mounted for sliding movement on the shaft coupling to open the forward recess for reception of a brush therein and to close the forward recess for retaining the brush, the shaft coupling having second retaining means at its forward end, the sleeve having retaining means intermediate the shaft coupling first and second retaining means, a spring member fitted over the shaft coupling surface recess in engagement with the shaft coupling shoulder and with the sleeve retaining means so that the spring urges the sleeve into closing relationship with the shaft coupling forward recess to retain a brush within said recess for rotation with the shaft coupling and drive shaft, the shaft coupling second retaining means for retaining both the sleeve and the spring on the shaft coupling, and the sleeve having a length extending from the shaft coupling second retaining means to a shaft coupling surface beyond the shaft coupling shoulder so that the sleeve remains in covering relation to the spring member.

4. A shaft coupling for a rotary drive shaft in combination with a tube cleaning brush comprising a shaft coupling secured to an end of the drive shaft, the shaft coupling having a shaft coupling recess for receiving the brush for rotation with the drive shaft and shaft coupling, a sleeve mounted for sliding movement on the shaft coupling to open the shaft coupling recess for reception of the brush therein and to close the recess for retaining the brush, the shaft coupling having first and second retaining means, the sleeve having retaining means intermediate the said first and second retaining means, a spring member fitted over the shaft coupling in engagement with the shaft coupling first retaining means and with the sleeve retaining means so that the spring urges the sleeve into closing relationship with the shaft coupling recess to retain the brush within the recess for rotation with the shaft coupling and drive shaft, the shaft coupling second retaining means for retaining both the sleeve and the spring on the shaft coupling, and the brush having canted edges for retaining the brush within the shaft coupling recess.

* * * * *